US006357364B1

(12) United States Patent
Maloney et al.

(10) Patent No.: US 6,357,364 B1
(45) Date of Patent: Mar. 19, 2002

(54) PAPER PALLET

(75) Inventors: Michael Maloney; Kevin McNabb; Marlyn Johnson; Richard Winkleman, all of Minneapolis; Randolph J. Lehner, Brooklyn Center; Ted G. Young, Buffalo; Keith Richard Benson, Bloomington; Peter John Folkerds, New Hope; Leroy Miller, Brooklyn Park, all of MN (US); James Brian Neubauer, Roberts, WI (US); Lee Sheldon Olmsted, Elk River; Richard Thomas Williams, Mound, both of MN (US)

(73) Assignee: Protecta-Pack Systems, Minneapolis, MN (US)

( * ) Notice: Subject to any disclaimer, the term of this patent is extended or adjusted under 35 U.S.C. 154(b) by 0 days.

(21) Appl. No.: 09/590,587

(22) Filed: Jun. 8, 2000

Related U.S. Application Data

(60) Provisional application No. 60/155,048, filed on Sep. 21, 1999.

(51) Int. Cl.[7] ..... B65D 19/00

(52) U.S. Cl. ..... 108/51.3; 108/51.11

(58) Field of Search ..... 108/51.3, 56.1, 108/56.3, 51.11

(56) References Cited

U.S. PATENT DOCUMENTS

| | | | | | |
|---|---|---|---|---|---|
| 3,434,435 | A | * | 3/1969 | Achermann et al. | 108/51.3 |
| 4,714,026 | A | | 12/1987 | Yamaguchi et al. | |
| 5,230,291 | A | | 7/1993 | Juvik-Woods | |
| 5,269,219 | A | | 12/1993 | Juvik-Woods | |
| 5,329,861 | A | | 7/1994 | McCarthy | |
| 5,337,680 | A | | 8/1994 | Johnston et al. | |
| 5,370,062 | A | | 12/1994 | Johnston et al. | |
| 5,406,892 | A | | 4/1995 | Kilpatrick et al. | |
| 5,427,019 | A | | 6/1995 | Moorman | |
| 5,465,672 | A | * | 11/1995 | Boyse et al. | 108/51.3 |
| 5,493,962 | A | | 2/1996 | McCarthy | |
| 5,531,165 | A | | 7/1996 | Taravella et al. | |
| 5,537,937 | A | | 7/1996 | Juvik-Woods | |
| 5,562,048 | A | | 10/1996 | Gottlieb | |
| 5,595,125 | A | | 1/1997 | Bridges, Jr. | |
| 5,603,258 | A | | 2/1997 | Besaw | |
| 5,672,412 | A | * | 9/1997 | Phares et al. | 108/51.3 X |
| 5,809,903 | A | | 9/1998 | Young, Jr. | |
| 5,921,187 | A | | 7/1999 | Wang | |
| 5,934,202 | A | | 8/1999 | Lai | |
| 5,941,177 | A | * | 8/1999 | Anderson | 108/51.3 |
| 5,996,509 | A | | 12/1999 | Lai | |

* cited by examiner

*Primary Examiner*—Janet M. Wilkens
(74) *Attorney, Agent, or Firm*—Patterson, Thuente, Skaar & Christensen, P.A.

(57) ABSTRACT

A paper pallet generally comprises support blocks, a top pad, and a wrap. The support blocks are of a comb configuration, e.g., honeycomb or hexacomb. The top pad is of a corrugated material and is positioned above the support blocks. The wrap is also of a corrugated material and wraps, via direct contact, the top and side surfaces of the top pad as well as wrapping, via direct contact, at least two side surfaces of the support blocks.

23 Claims, 7 Drawing Sheets

PAPER PALLET

CLAIM TO PRIORITY

The present invention claims priority to U.S. Provisional Patent Application No. 60/155,048, filed Sep. 21, 1999, and entitled "Paper Pallet". The identified provisional patent application is hereby incorporated by reference.

FIELD OF THE INVENTION

The present invention is related to pallets and, more specifically, pallets constructed of corrugated components that include a corrugated wrap, a corrugated topper and corrugated support blocks.

BACKGROUND OF THE INVENTION

Paper pallets are gaining in popularity as they provide consumers with an easily recyclable option as compared to the standard wood pallets that have been used for years. However, paper pallets while desirably recyclable often bring other undesirable features. For instance, paper pallets often provide the user with a pallet of reduced strength as compared to a wood pallet of similar size and configuration. The reduced strength limits the load that the pallet may carry and additionally, allows for the damaging of the pallet itself under heavy loads. As such, there is a need in the art for a paper pallet that provides additional strength and stability, as well as easy assembly through the use of corrugated materials, e.g., a corrugated topper, corrugated support blocks, and a corrugated wrap.

SUMMARY OF THE INVENTION

The needs described above are in large measure met by the paper pallet of the present invention. The paper pallet generally comprises support blocks, a top pad, and a wrap. The support blocks are of a comb configuration, e.g., honeycomb or hexacomb. The top pad is of a corrugated material and is positioned above the support blocks. The wrap is also of a corrugated material and wraps, via direct contact, the top and side surfaces of the top pad as well as wrapping, via direct contact, at least two side surfaces of the support blocks.

The wrap may continue to wrap four sides of the six-sided support block so that the wrap is placed in a position intermediate the support block and top pad and, thereby, may be secured to the bottom surface of the top pad. Alternatively, the wrap may wrap to completely encompass the top pad and support blocks, i.e., in a shell configuration, such that the edges of the wrap join at a seam above the top pad. The wrap generally presents both an upper exterior surface and a lower exterior surface of the pallet; no additional platforms or pads are required above or below the wrap itself. The pallet may additionally include a second wrap for the wrapping of a central support block. This second wrap is secured to the bottom surface of the top pad when the second wrap is used.

A method for assembling the pallet generally includes the steps of: (1) presenting the wrap in a flat orientation; (2) securing the top pad to a central portion of the wrap; (3) securing one surface of the support blocks to a portion of the wrap proximate each side of the central portion, i.e., to each side of the top pad; (4) wrapping a second surface of each of the secured support blocks with the wrap; and (5) rolling each of the secured blocks to a position proximate the bottom surface of the secured top pad.

DETAILED DESCRIPTION OF THE PREFERRED EMBODIMENTS

Figures 1, 2:
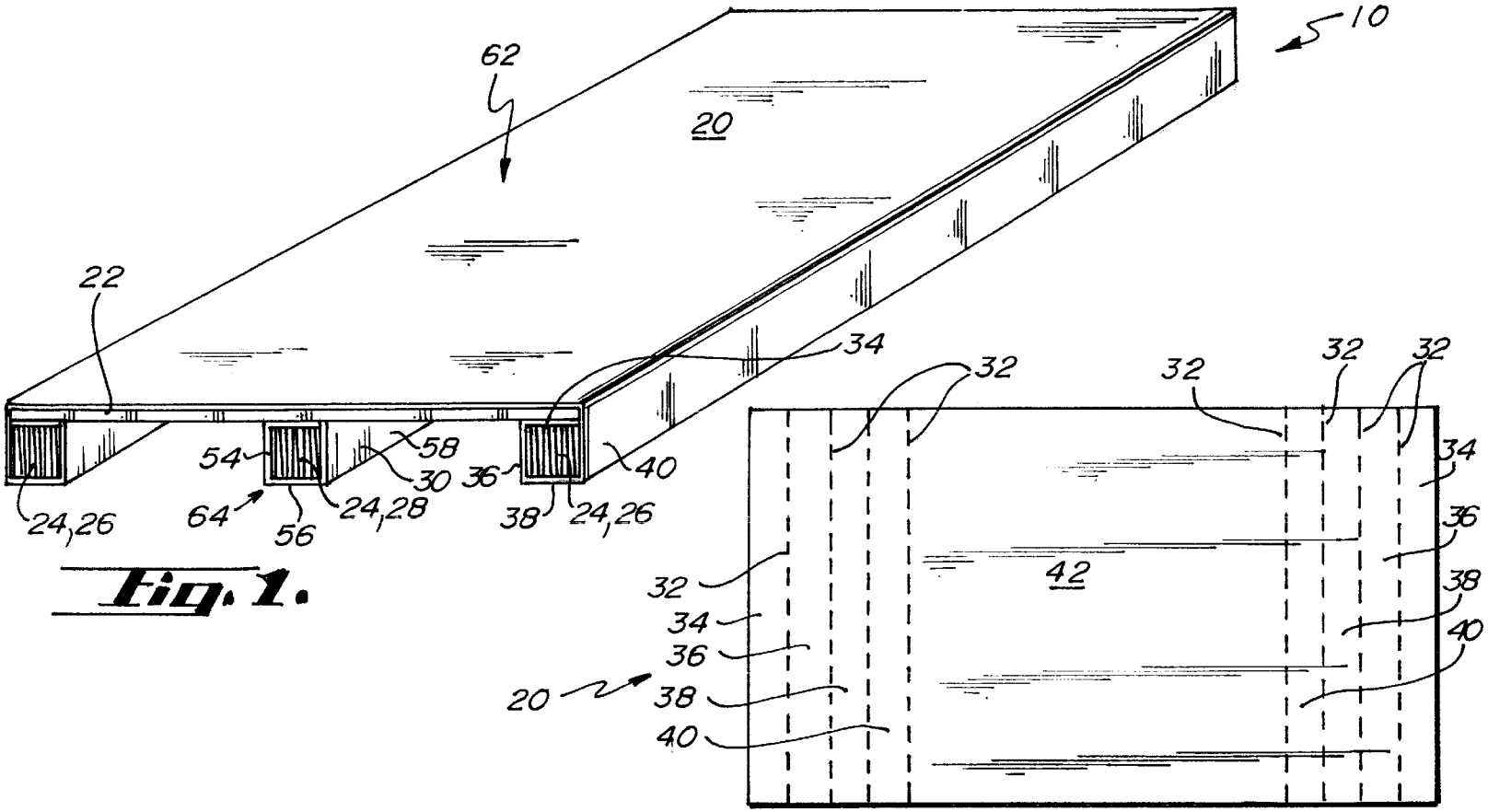
FIG. 1 provides a perspective view of a two-way paper pallet of the present invention.
FIG. 2 is an inside view of a wrap of the two-way paper pallet of FIG. 1.

A paper pallet 10 of the present invention may take a two-way configuration, see FIGS. 1–5, or, alternatively, a four-way configuration, see FIGS. 6–9. Each paper pallet 10, however, incorporates standard elements, i.e., a wrap 20, a top pad 22 and a plurality of support blocks 24.

Referring to FIGS. 1–5, the two-way configuration of paper pallet 10 preferably includes wrap 20, top pad 22, three support blocks 24, which comprise two side runners 26 and a central runner 28, and a central runner wrap 30.

Wrap 20, an inside view of which is depicted in FIG. 2, preferably comprises a sheet of single-wall corrugated having a kraft outer liner and a kraft inner liner separated by a corrugating medium incorporating a C-flute, i.e., 42 flutes per foot, and having a basis weight of 275 lbs./1000 $ft^2$. Wrap 20 is preferably of a rectangular configuration with the direction of corrugation along the elongate side of the rectangle. Of course, other types of corrugated, e.g., different basis weights, flute sizes and classifications, etc., may be used without departing from the spirit or scope of the invention. As shown in FIG. 2, the inside of each side of wrap 20 is preferably die-cut in four locations, as indicated by the dashed lines 32, to define a section-A 34, a section-B 36, a section-C 38, a section-D 40, and a central section 42. The die-cuts enable bending of section-A through section-D around side runners 26 (see FIG. 1).

Wrap 20 may be of any suitable size, however, by way of non-limiting example, the following dimensions have been found to be appropriate: (1) overall sheet—77 3/16 by 48 inches; (2) section-A—5 1/8 by 48 inches; (3) section-B—3 15/16 by 48 inches; (4) section-C—5 3/16 by 48 inches; (5) section-D—4 7/16 by 48 inches; and (6) central section—39 13/16 by 48 inches.

Figure 3:
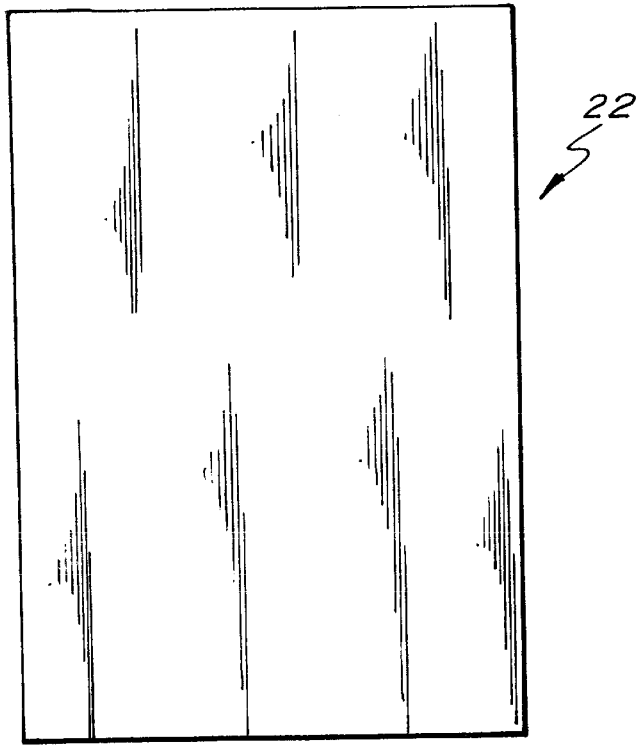
FIG. 3 is an inside view of a top pad of the two-way paper pallet of FIG. 1.

Top pad 22, an inside view of which is depicted in FIG. 3, preferably comprises a sheet of corrugated, e.g. tri-wall corrugated, having a kraft outer liner and a kraft inner liner, wherein the kraft liners are separated by a corrugating medium incorporating a combination ABC-flute. The corrugated preferably has a basis weight of 1100 lbs./1000 $ft^2$. The direction of corrugation of top pad 22 may be opposite to the direction of corrugation of wrap 20, to provide additional strength and stability to paper pallet 10. Of course other types of corrugated, e.g., double-wall corrugated, single-wall corrugated, different flute sizes and combinations, different basis weights, etc., may be used without departing from the spirit or scope of the invention. Additionally, a plurality of top pads 22 may be used in combination without departing from the spirit or scope of the invention. In cooperation with the dimensions provided above, by way of non-limiting example, the dimensions of 48 by 39⅝ inches have been found to be appropriate for top pad 22.

Figure 4:
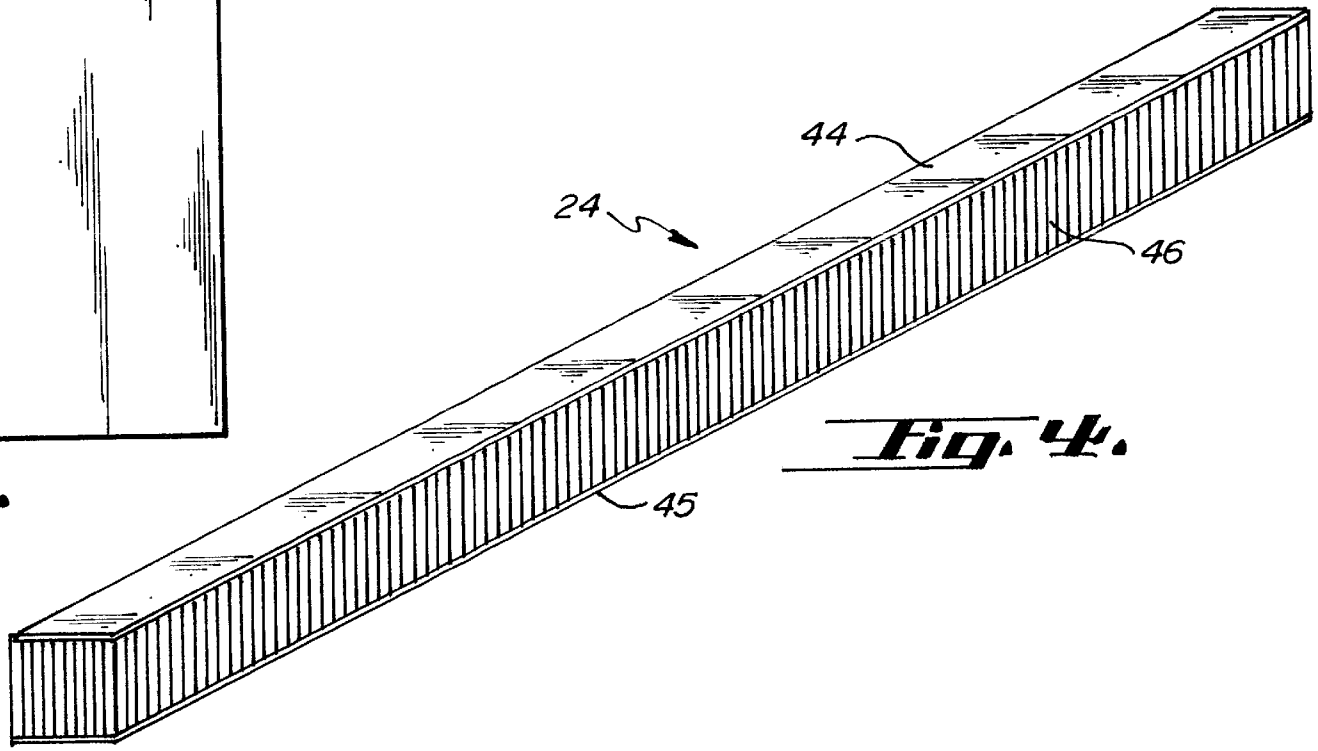
FIG. 4 is a perspective view of a honeycomb block of the two-way paper pallet of FIG. 1.

Support blocks 24, a perspective view of which is depicted in FIG. 4, are preferably of a paper honeycomb configuration and, more preferably, are HEXACOMB® blocks manufactured by Pactiv. The HEXACOMB® blocks preferably have a top kraft face 44, a bottom kraft face 45, and a type-3 core 46 separating the top and bottom faces. In cooperating with the dimensions provided above, by way of non-limiting example, the dimensions of 48 by 5 by 3¾ have been found to be appropriate for each of the three support blocks 24.

Figure 5:
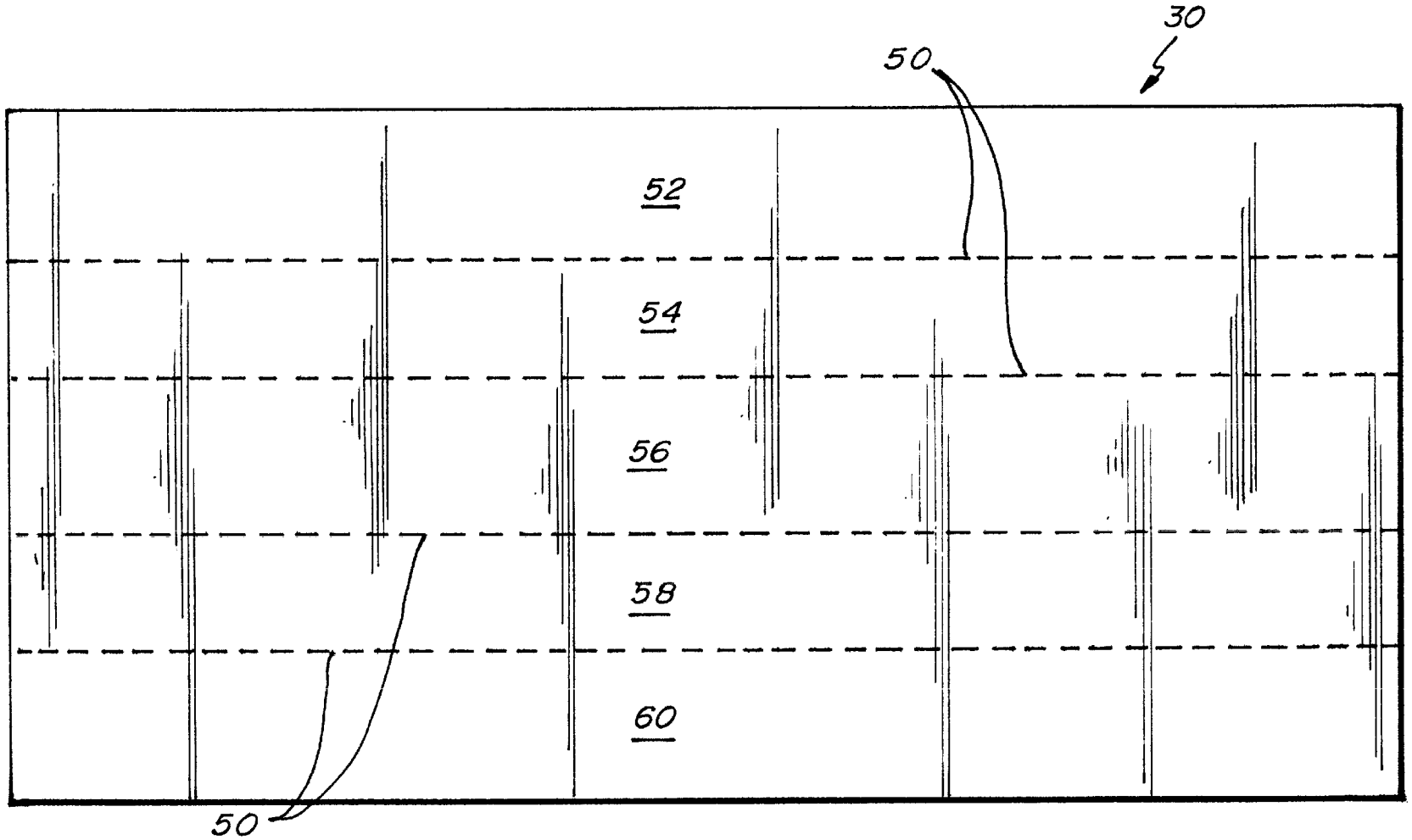
FIG. 5 is an inside view of a runner of the two-way paper pallet of FIG. 1.
Figure 6:
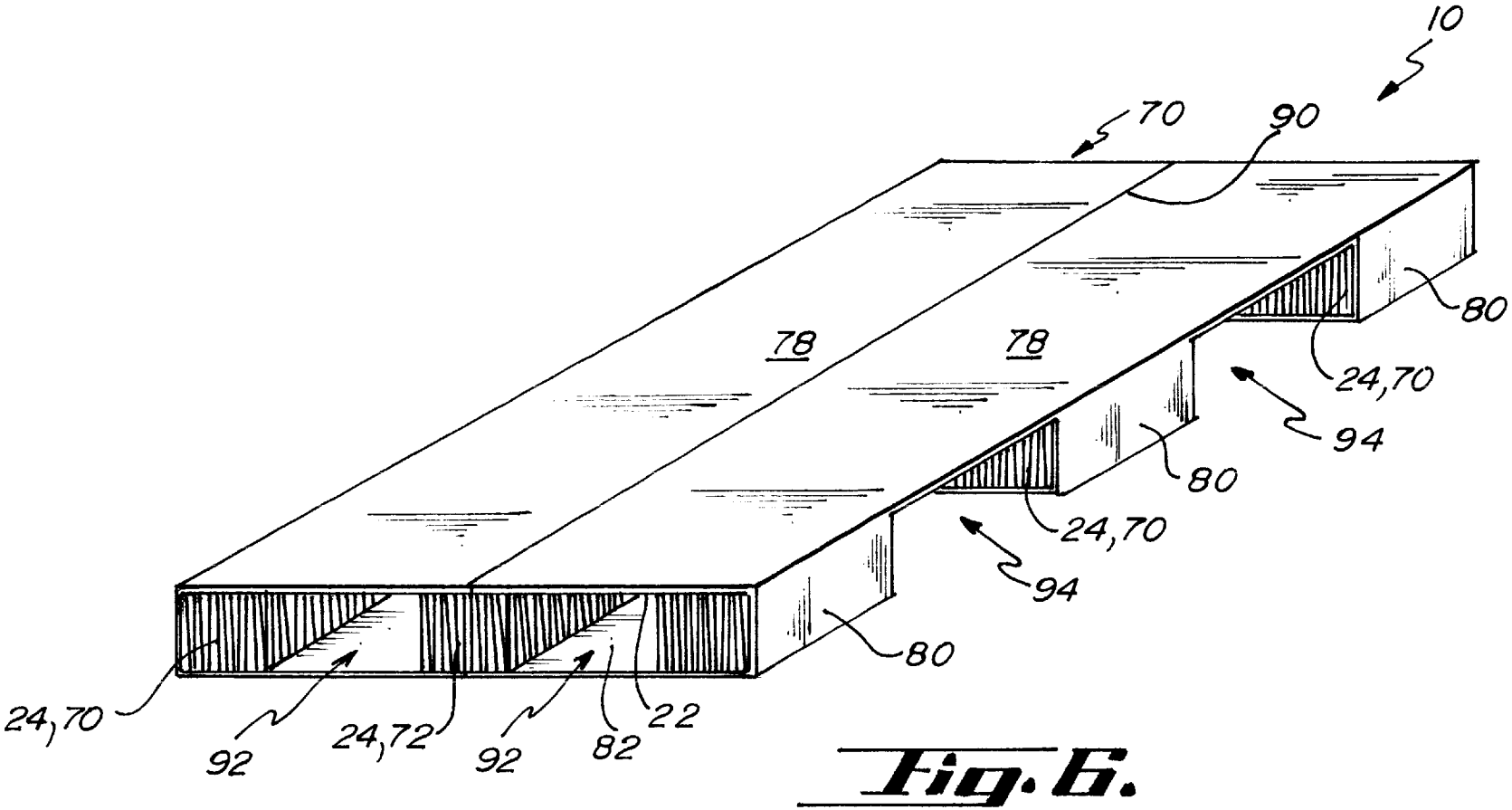
FIG. 6 is a perspective view of a four-way paper pallet of the present invention.

Central runner wrap 30, an inside of view of which is depicted in FIG. 5, preferably comprises a sheet of single-wall corrugated having a kraft outer liner and a kraft inner liner separated by a corrugating medium incorporating a C-flute. The sheet of corrugated preferably has a basis weight of 275 lbs./1000 $ft^2$. Central runner wrap 30 is preferably of a rectangular configuration with the direction of corrugation along the elongate side of the rectangle. Of course, other types of corrugated, e.g., different basis weights, flute sizes and combinations, etc., may be used without departing from the spirit or scope of the invention. As shown in FIG. 5, the inside central runner wrap 30 is preferably die-cut in four locations, as indicated by dashed lines 50, to define a section-E 52, a section-F 54, a section-G 56, a section-H 58, and a section-I 60. The die-cuts enable bending of section-E through section-I around central runner 28.

In cooperating with the dimensions provided above, by way of non-limiting example, the following dimensions for central runner wrap 30 have been found to be appropriate: (1) overall size—23⅞ by 48 inches; (2) section-E—5¼ by 48 inches; (3) section-F—4³⁄₁₆ by 48 inches; (4) section-G—5⁵⁄₁₆ by 48 inches; (5) section-H—4 by 48 inches; and (6) section-I—5⅛ by 48 inches.

In assembling the two-way configuration of paper pallet 10, a side runner assembly 62 is created with side runners 26, wrap 20 and top pad 22. To make side runner assembly 62, top kraft face 44 of side runners 26 are each preferably secured by adhesive to one of section-D 40 of wrap 20. Top pad 22 is preferably secured by adhesive to central section 42 of wrap 20. Each side runner 26 is then preferably rolled toward central section 42 such that one side of side runner 26 is covered by section-C 38, bottom kraft face 45 of side runner 26 is covered by section-B 36, and the second side of side runner 26 is covered by section-A 34. With respect to each side runner 26, the outside surface of section-A 34 is now in position immediately below top pad 22, i.e., top pad 22 and the outside of section-A 34 are substantially parallel, and is preferably secured by adhesive to top pad 22. Wrapping side runners 26 in this manner, wherein all sides of each side runner 26 are enclosed by wrap 20, and wrap 20 is secured, at least in part, to both the top and bottom surface of top pad 22, provides extra strength and stability to the two-way configuration of paper pallet 10 and helps to reduce the possibility that side runners 26 will separate from wrap 20 or that wrap 20 will separate from top pad 22.

Central runner 28 is preferably wrapped in central runner wrap 30 to create a central runner assembly 64. In achieving this objective, top kraft face 44 of central runner 28 is preferably secured by adhesive to section-G 56 of central runner wrap 30. Then, section-H 58 of central runner wrap 30 is folded up to cover a first side of central runner 28 and section-I 60 is folded to substantially cover the bottom kraft face central runner 28, where section-I 60 is preferably secured by adhesive. Section-F 54 of central runner wrap 30 is then folded up to cover a second side of central runner 28 and section-E 52 is folded to lay atop secured section-I 60. Section-E 52 is preferably secured by adhesive to secured section-I 60.

Central runner assembly 64 is preferably placed central to side runners 26 in side runner assembly 62, as shown in FIG. 1. In cooperating with the dimensions provided above, by way of non-limiting example, a space of approximately 12⁷⁄₁₆ by 48 inches is provided on either side of central runner assembly 64, which allows for placement of forks for lifting.

Referring to FIGS. 6–9, the four-way configuration of paper pallet preferably includes wrap 20, top pad 22, and nine support blocks 24, which comprise six side runners 70 and three central runners 72.

Figure 7:
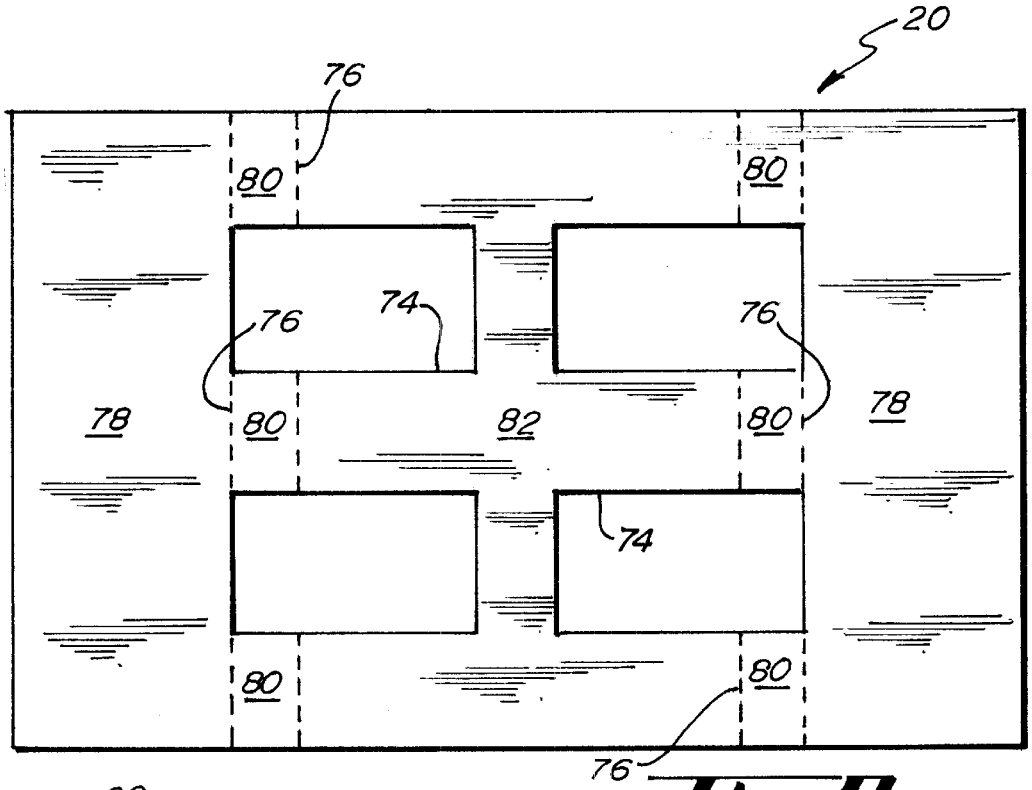
FIG. 7 is an inside view of a wrap of the four-way paper pallet of FIG. 6.

Wrap 20, an inside view of which is depicted in FIG. 7, preferably comprises a sheet of single-wall corrugated having a kraft outer liner and a kraft inner liner separated by a corrugating medium incorporating a C-flute. The sheet of corrugated preferably has a basis weight of 275 lbs./1000 $ft^2$. Wrap 20 is preferably of a rectangular configuration with the direction of corrugation along the elongate side of the rectangle. Of course, other types of corrugated, e.g., different basis weights, flute sizes and combinations, etc., may be used without departing from the spirit or scope of the invention. As shown in FIG. 7, wrap 20 preferably includes four rectangular cut-outs 74. Further, the inside of each side of wrap 20 is preferably die-cut along two lines, as indicated by the dashed lines 76, to define a section-J 78, a section-K 80 and a central section 82. The die-cuts enable bending of section-J 78 and section-K 80 around side runners 70 (see FIG. 6).

Wrap 20 may be of any suitable size, however, by way of non-limiting example, the following dimensions have been found to be appropriate: (1) overall sheet—68⅞ by 44 inches; (2) section-J—15 by 44 inches; (3) section-K—3¾ by 44 inches; (4) central section—3⅜ by 44 inches; and (5) cut-outs—16¼ by 10 inches.

Figure 8:
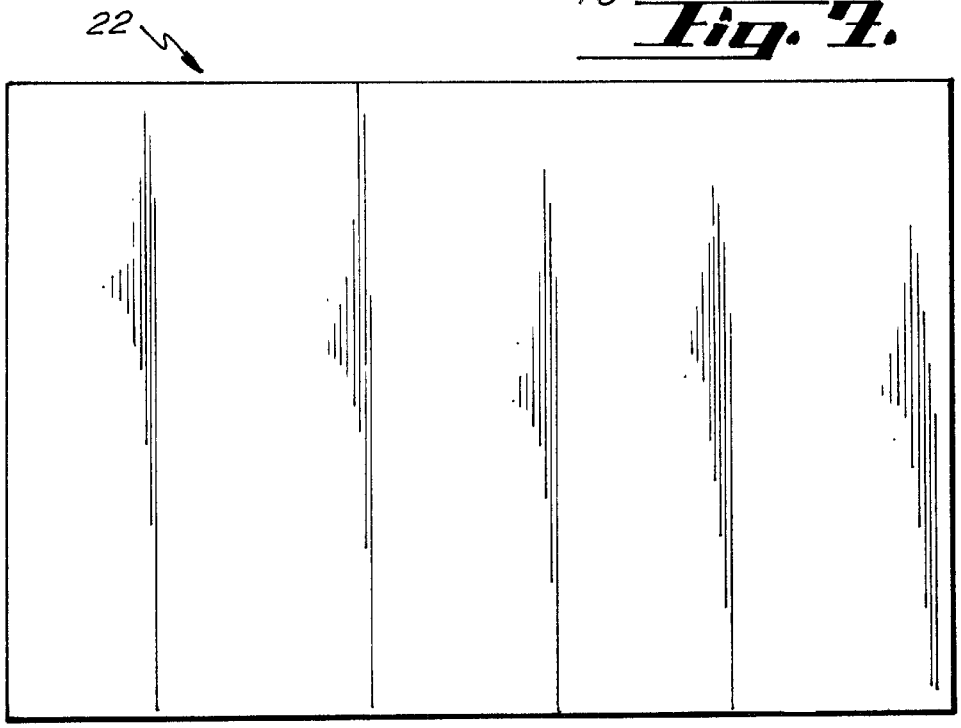
FIG. 8 is an inside view of a top pad of the four-way paper pallet of FIG. 6.

Top pad 22, an inside view of which is depicted in FIG. 8, preferably comprises a sheet of double-wall corrugated having a kraft outer liner and a kraft inner liner, wherein the kraft liners are separated by a corrugating medium incorporating a combination B/C flute. The double wall corrugated preferably has a basis weight of 350 pounds/1000 $ft^2$. The direction of corrugation of top pad 22 may be opposite to the direction of corrugation of wrap 20, to provide additional strength and stability to paper pallet 10. Of course, other types of corrugated, e.g., single-wall corrugated, tri-wall corrugated, different flute sizes and combinations, different basis weights, etc., may be used without departing from the spirit or scope of the invention. Additionally, a plurality of top pads 22 may be used in combination with each other without departing from the spirit or scope of the invention. In cooperation with the dimensions provided above, by way of non-limiting example, the dimensions of 30 by 44 inches for top pad 22 have been found to be appropriate.

Figure 9:
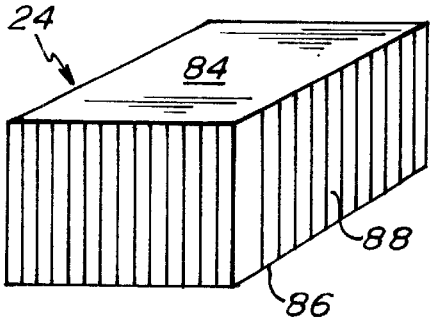
FIG. 9 is a perspective view of a honeycomb block of the four-way paper pallet of FIG. 6.

Support blocks 24, a perspective view of which is depicted in FIG. 9, are preferably of a paper honeycomb configuration and, more preferably, are HEXACOMB® blocks manufactured by Pactiv. The HEXACOMB® blocks preferably have a top kraft face 84, a bottom kraft face 86 and a type-3 core 88 separating the top and bottom faces. In cooperating with the dimensions provided above, by way of non-limiting example, the dimensions of 8 by 5 by 3¾ inches have been found to be appropriate for each of the nine support blocks 24.

In assembling the four-way configuration of paper pallet 10, top kraft face 84 of three of side runners 70 are preferably secured by adhesive to a first side of central section 82 of wrap 20, with the side runner's elongate side proximate die-cut line 76 of section-K 80 and its short side proximate the edge of wrap 20 and/or the edge of cut-out 74. The three remaining side runners 70 are preferably placed similarly to the opposite side of wrap 20. Central runners 72 are preferably secured by adhesive to central section 82 of wrap 20 in a manner to be in substantial alignment with but intermediate to side runners 70. Top pad 22 is then preferably secured by adhesive to bottom face 86 of all support blocks 24, i.e., side runners 70 and central runners 72.

With top pad 22 secured, section-K 80 of wrap 20 is folded/bent to cover the elongate sides of all of side runners 70. Next, section-J 78 of wrap 20 is folded/bent to come over top pad 22 whereby section-J 78 of one side of wrap 20 meets section-J 78 of the other side of wrap 20 to create a seam 90 over the top face of top pad 90. Each of section-J 78 of wrap 20 is preferably secured to top pad 22 by adhesive to complete assembly of paper pallet 10. The four-way configuration of paper pallet may now raised and lowered by a forklift in the elongate direction of paper pallet 10 via openings 92, see FIG. 6, or in the shortened direction of paper pallet via openings 94.

Note that in the four-way configuration of paper pallet 10, because wrap 20 substantially encloses support blocks 24, i.e., side runners 70 and central runners 72, provides only a single seam 90 at the top of paper pallet 10, and because support blocks 24 are secured to both wrap 20 and top pad 22, extra strength and stability is provided to paper pallet 10. Further, these features help to reduce the possibility that support blocks 24 will separate from wrap 20 or top pad 22 during lifting.

It should be noted that top pad 22 may be eliminated from the two-way configuration or four-way configuration of paper pallet 10 if the load to be supported by paper pallet does not require the additional strength added by top pad 22.

Figure 12:
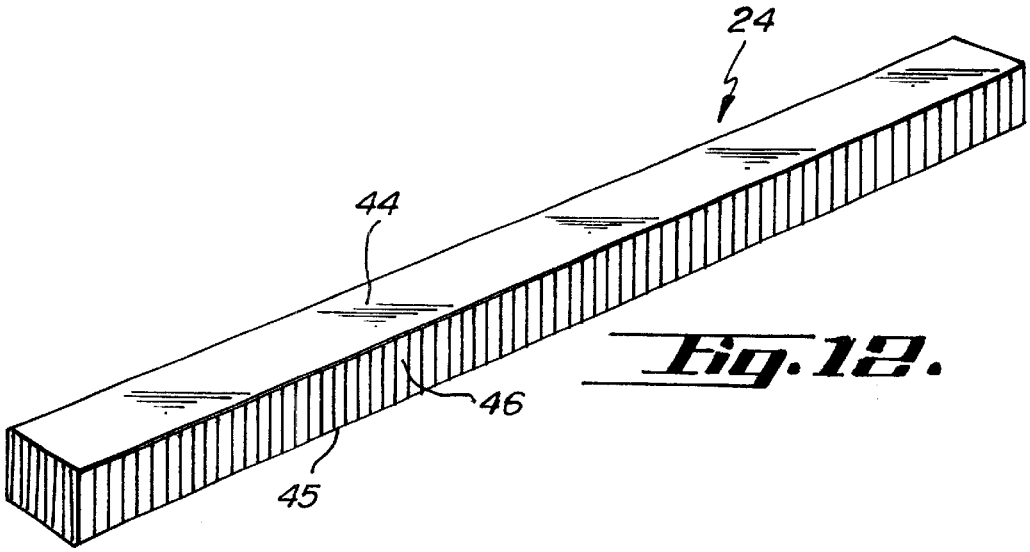
FIG. 12 is a perspective view of a honeycomb block of the two-way paper pallet of FIG. 10.
Figure 10:
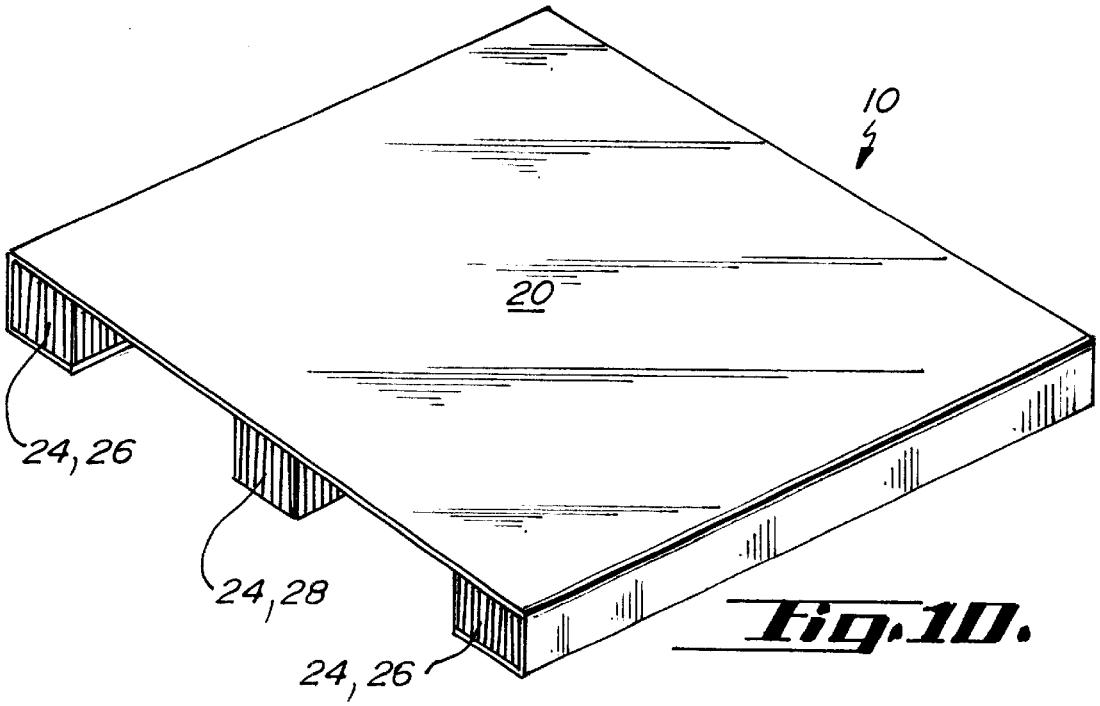
FIG. 10 is a perspective view of alternative embodiment of a two-way paper pallet.
Figure 11:
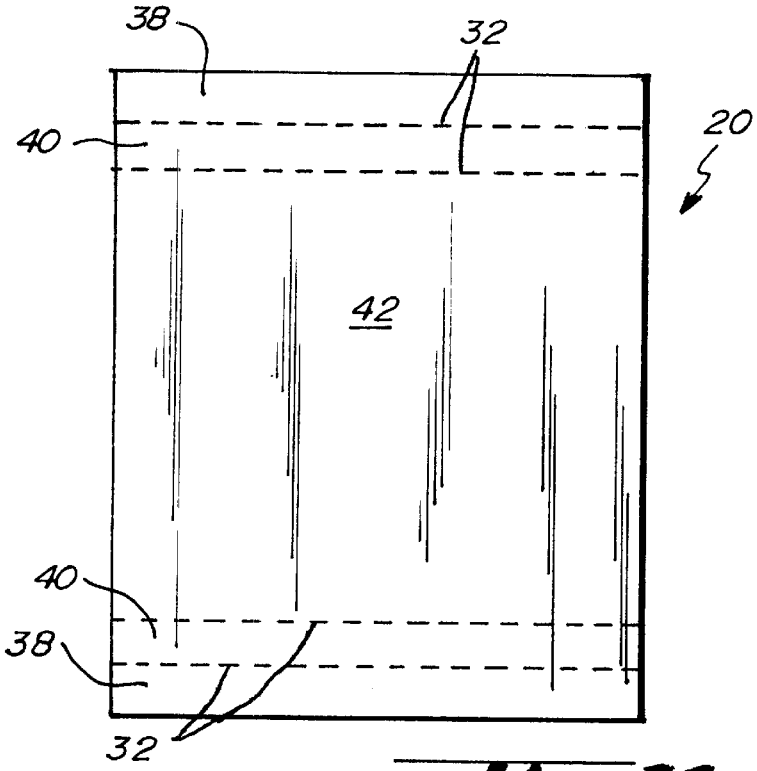
FIG. 11 is an inside view of a wrap of the two-way paper pallet of FIG. 10.

Referring to FIGS. 10–12, an alternative embodiment of the two-way configuration of paper pallet 10 is shown and preferably includes wrap 20 and three support blocks 24, which comprise two side runners 26 and a central runner 28. While not depicted, top pad 22 may be incorporated as well.

Wrap 20, an inside view of which is depicted in FIG. 1, preferably comprises a sheet of single-wall corrugated having a kraft outer liner and a kraft inner liner separated by a corrugating medium incorporating a BC-flute and having a basis weight of 350 lbs./1000 $ft^2$. Wrap 20 is preferably of a rectangular configuration with the direction of corrugation along the elongate side of the rectangle. Of course, other types of corrugated, e.g., different basis weights, flute sizes and classifications, etc., may be used without departing from the spirit or scope of the invention. As shown in FIG. 11, the inside of each side of wrap 20 is preferably die-cut in two locations, as indicated by the dashed lines 32, a section-C 38, a section-D 40, and a central section 42. The die-cuts enable bending of section-C through section-D around side runners 26 (see FIG. 10).

Wrap 20 may be of any suitable size, however, by way of non-limiting example, the following dimensions have been found to be appropriate: (1) overall sheet—57 13/16 by 48 inches; (2) section-C—5 by 48 inches; (5) section-D—4 1/16 by 48 inches; and (6) central section—39 11/16 by 48 inches.

Top pad 22, if used, is preferably similar to top pad 22 configuration of FIG. 3 and preferably comprises a sheet of tri-wall corrugated having a kraft outer liner and a kraft inner liner, wherein the kraft liners are separated by a corrugating medium incorporating a combination ABC-flute. The tri-wall corrugated preferably has a basis weight of 1100 lbs./1000 $ft^2$. The direction of corrugation of top pad 22 may be opposite to the direction of corrugation of wrap 20, to provide additional strength and stability to paper pallet 10. Of course other types of corrugated, e.g., double-wall corrugated, single-wall corrugated, different flute sizes and combinations, different basis weights, etc., may be used without departing from the spirit or scope of the invention. Additionally, a plurality of top pads 22 may be used in combination without departing from the spirit or scope of the invention.

Support blocks 24, a perspective view of which is depicted in FIG. 12, are preferably of a paper honeycomb configuration and, more preferably, are HEXACOMB® blocks manufactured by Pactiv. The HEXACOMB® blocks preferably have a top kraft face 44, a bottom kraft face 45, and a type-3 core 46 separating the top and bottom faces. In cooperating with the dimensions provided above, by way of non-limiting example, the dimensions of 48 by 5 by 3¾ have been found to be appropriate for each of the three support blocks 24.

In assembling the alternative embodiment of the two-way configuration of paper pallet 10, a side runner assembly 62 is created with side runners 26, wrap 20, and top pad 22 (if used). To make side runner assembly 62, top kraft face 44 of side runners 26 are each preferably secured by adhesive to one of section-C 38 of wrap 20. Top pad 22, if used, is preferably secured by adhesive to central section 42 of wrap 20. Each side runner 26 is then preferably rolled toward central section 42 such that one side of core 46 of side runner 26 is covered by section-D 40. Bottom kraft face 45 of side runner 46 may additionally be secured to central area 42, or to the bottom surface of top pad 22, if top pad 22 is used.

Central runner 28 is preferably secured by adhesive to central section 42, or to top pad 22, if used. Central runner 28 is preferably placed central to side runners 26 in side runner assembly 62, as shown in FIG. 10. In cooperating with the dimensions provided above, by way of non-limiting example, a space of approximately 12½ by 48 inches is provided on either side of central runner 28, which allows for placement of forks for lifting.

The present invention may be embodied in other specific forms without departing from the spirit of the essential attributes thereof; therefore, the illustrated embodiment should be considered in all respects as illustrative and not restrictive, reference being made to the appended claims rather than the foregoing description to indicate the scope of the invention.

What is claimed:

1. A two-way pallet, comprising:

a plurality of support blocks, wherein each of said plurality of support blocks has a first, second, third and fourth side surface, and two end surfaces;

a top pad, wherein said top pad is of a corrugated material and has four sides, a top surface and a bottom surface, and wherein said bottom surface is positioned proximate said first side surface of said plurality of support blocks; and a wrap, wherein said wrap is of a corrugated material, and wherein said wrap wraps said top surface and at least two of said four sides of said top pad, and wherein said wrap is fixedly secured to both said top and bottom surface of said top pad and to at least one surface of at least two of said plurality of support blocks enabling two-way lifting of said pallet.

2. The pallet of claim 1, wherein said wrap has a direction of corrugation and wherein said top pad has a direction of corrugation that is opposite to said direction of corrugation of said wrap.

3. The pallet of claim 1, wherein said wrap comprises a seamless layer of corrugated material.

4. The pallet of claim 1, wherein said wrap provides both an upper exterior surface and a lower exterior surface of said pallet.

5. The pallet of claim 1, wherein at least one of said plurality of support blocks is provided with a support block wrap, and wherein said support block wrap is positioned central to said bottom surface of said top pad and is secured thereto.

6. A two-way pallet, comprising:

a top pad, wherein said top pad is of a corrugated material, and wherein said top pad has four side surfaces, a top surface, and a bottom surface;

at least two side support blocks, wherein each of said at least two side support blocks has a first, second, third, and fourth side surface, and two end surfaces, and wherein said first side of one of said at least two side support blocks is positioned out to an edge of one of said four side surfaces and beneath said bottom surface of said top pad, and wherein said first side of one of said at least two side support blocks is positioned out to an edge of a second of said four side surfaces, said first and second side surfaces in a parallel orientation, and beneath said bottom surface of said top pad so that said at least two side support blocks are in a parallel orientation; and a central support block, wherein said central support block is positioned central to said bottom surface of said top pad; and a wrap wherein said wrap is of a corrugated material, and wherein said wrap wraps said top surface and at least two of said four side surfaces of said top pad, and wherein said wrap is fixedly secured to both said top and bottom surface of said top pad and to at least one surface of each of said at least two side support blocks enabling two-way lifting of said pallet.

7. The pallet of claim 6, wherein said wrap has a direction of corrugation and wherein said top pad has a direction of corrugation that is opposite to said direction of corrugation of said wrap.

8. The pallet of claim 6, wherein said wrap comprise a seamless layer of corrugated material.

9. The pallet of claim 6, wherein said wrap provides both an upper exterior surface and a lower exterior surface of said pallet.

10. The pallet of claim 6, wherein said central support block is provided with a support block wrap, and wherein said support block wrap is positioned central to said bottom surface of said top pad and is fixedly secured thereto.

11. A two-way pallet, comprising:

a plurality of support means, each having four side surfaces, for providing strength and rigidity to said pallet, and for supporting a corrugated pad means and a corrugated wrap means;

said corrugated pad means for providing strength and rigidity to said pallet; and said corrugated wrap means for wrapping said corrugated pad means, said corrugated wrap means fixedly secured to an upper and lower surface of said corrugated pad means and said support means, said corrugated wrap means fixedly secured to at least one side surface of at least two of said plurality of support means enabling two-way lifting of said pallet, and for providing stability to said pallet.

12. The pallet of claim 11, wherein said corrugated wrap means has a direction of corrugation and wherein said corrugated pad means has a direction of corrugation opposite to said direction of corrugation of said corrugated wrap means.

13. The pallet of claim 11, wherein said corrugated wrap means for providing a seamless wrap about said corrugated pad means.

14. The pallet of claim 11, wherein said corrugated wrap means for providing both an upper exterior surface and a lower exterior surface of said pallet.

15. The pallet of claim 11, second corrugated wrap means for wrapping only a single comb configuration support means and for securing said single comb configuration support means to said corrugated pad means.

16. A method of assembling a two-way pallet, wherein said pallet is comprised of a plurality of support blocks, a corrugated top pad, and a corrugated wrap, the method comprising the steps of:

presenting said corrugated wrap in a flat orientation;

fixedly securing a top surface of said corrugated top pad to a central portion of said corrugated wrap;

fixedly securing a surface of one of said plurality of support blocks to a portion of said corrugated wrap proximate each side of said central portion;

wrapping all surfaces of each the secured plurality of support blocks with said corrugated wrap; and rolling each of said secured plurality of support blocks to a position proximate a bottom surface of the secured corrugated top pad.

17. The method of claim 16, wherein said corrugated top pad has a direction of corrugation, and wherein said corrugated wrap has a direction of corrugation, and the method further comprising the step of orienting said direction of corrugation of said corrugated top pad opposite to said direction of corrugation of said corrugate wrap.

18. The method of claim 16, further comprising the step of wrapping a third and fourth surface of each of the secured plurality of support blocks.

19. The method of claim 18, further comprising the step of fixedly securing said corrugated wrap to a bottom surface of said corrugated top pad.

20. The method of claim 16, further comprising the steps of:

individually wrapping at least one of said plurality of support blocks with a support block wrapper; and securing said support block wrapper to a bottom surface of said corrugated top pad.

21. A two-way pallet, comprising:

a plurality of support blocks, wherein each of said support blocks incorporates a comb configuration core, and wherein each of said plurality of support blocks has a first, second, third and fourth side surface, and two end surfaces;

a top pad, wherein said top pad is of a corrugated material and has four sides, a top surface and a bottom surface, and wherein said bottom surface is positioned proximate said first side surface of said plurality of support blocks; and a wrap, wherein said wrap is of a corrugated material, and wherein said wrap wraps said top surface and at least two of said four sides of said top pad, and wherein said wrap is fixedly secured to both said top and bottom surface of said top pad and to at least one surface of at least two of said plurality of support blocks enabling two-way lifting of said pallet.

22. A two-way pallet, comprising:

a plurality of comb configuration support means, each having four side surfaces, for providing strength and rigidity to said pallet, and for supporting a corrugated pad means and a corrugated wrap means;

said corrugated pad means for providing strength and rigidity to said pallet; and said corrugated wrap means for wrapping said corrugated pad means, said corrugated wrap means fixedly secured to an upper and lower surface of said corrugated pad means and said comb configuration support means, said corrugated wrap means fixedly secured to at least one side surface of at least two of said plurality of comb configuration support means enabling two-way lifting of said pallet, and for providing stability to said pallet.

23. A method of assembling a two-way pallet, wherein said pallet is comprised of a plurality of support blocks having a comb configuration, a corrugated top pad, and a corrugated wrap, the method comprising the steps of:

presenting said corrugated wrap in a flat orientation;

fixedly securing a top surface of said corrugated top pad to a central portion of said corrugated wrap;

fixedly securing a surface of one of said plurality of support blocks to a portion of said corrugated wrap proximate each side of said central portion;

wrapping all surfaces of each the secured plurality of support blocks with said corrugated wrap; and rolling each of said secured plurality of support blocks to a position proximate a bottom surface of the secured corrugated top pad.

* * * * *

UNITED STATES PATENT AND TRADEMARK OFFICE

CERTIFICATE OF CORRECTION

PATENT NO. : 6,357,364 B1
DATED : March 19, 2002
INVENTOR(S) : Maloney et al.

It is certified that error appears in the above-identified patent and that said Letters Patent is hereby corrected as shown below:

Column 4,
Line 46, "3-3/8" should read -- 31-3/8 --.

Column 5,
Line 30, "be" should be inserted between "now" and "raised".
Line 54, "FIG. 1" should be -- FIG. 11 --.

Column 7,
Line 54, "comprise" should be -- comprises --.

Column 10,
Line 16, "the" should be deleted and replaced with -- of --.

Signed and Sealed this

Thirtieth Day of July, 2002

*Attest:*

*Attesting Officer*

JAMES E. ROGAN
*Director of the United States Patent and Trademark Office*